United States Patent [19]

Branston

[11] 4,130,778

[45] Dec. 19, 1978

[54] DC PDP WITH DIVIDED CATHODE

[75] Inventor: David W. Branston, Erlangen, Germany

[73] Assignee: Siemens Aktiengesellschaft, Munich, Germany

[21] Appl. No.: 835,782

[22] Filed: Sep. 22, 1977

[30] Foreign Application Priority Data

Sep. 29, 1976 [DE] Fed. Rep. of Germany ..... 2643915

[51] Int. Cl.[2] ..... H05B 37/00; H05B 39/00; H05B 41/00

[52] U.S. Cl. ..... 315/169 TV; 313/326; 340/324 M

[58] Field of Search ..... 313/491, 494, 505, 517, 313/520, 326; 315/169 R, 169 TV; 340/324 M

[56] References Cited

U.S. PATENT DOCUMENTS 3,956,667 5/1976 Veith ..... 315/169 TV

*Primary Examiner*—Alfred E. Smith
*Assistant Examiner*—Robert E. Wise
*Attorney, Agent, or Firm*—Kenyon & Kenyon, Reilly, Carr & Chapin

[57] ABSTRACT

In a pictorial display device containing a matrix of gas discharge cells in which discharge path is divided into an auxiliary discharge space for operation with low voltage, followed by a second space with short path length and high field intensity for accelerating the electrons, the cathode is subdivided into subcathodes with each of which a group of auxiliary anodes is associated to obtain a narrow, approximately wedge-shaped gas discharge which is fired and passed on line by line.

7 Claims, 3 Drawing Figures

DC PDP WITH DIVIDED CATHODE

BACKGROUND OF THE INVENTION

This invention relates to pictorial display devices with a matrix of gas discharge cells in general and more particularly to an improved device of this nature.

Such a pictorial display device with which auxiliary anodes for controlling the rows and control electrodes for the brightness control of the columns are associated, and with an auxiliary discharge path between the cathode and the auxiliary anodes as well as an electron accelerating path between the control electrodes and the anode is described in U.S. Pat. No. 3,956,667. The hole matrix formed by a plate of insulating material divides the common discharge space into an auxiliary discharge space of relatively great length for operation with low voltage for the gas discharge current and a second space with short path length and high field intensity for accelerating the electrons. The insulating hole matrix serves as the carrier for the auxiliary anodes associated with the rows of the matrix. If desired, the control electrodes for the brightness control of the columns of the matrix can be arranged on the opposite flat side of the matrix. Cathode and anode are designed with large areas.

The electrons, which are generated in the linewise controlled auxiliary glow discharge and are moved toward the auxiliary anode, are accelerated and imaged, controlled dot by dot in the following discharge path of high field intensity by the correspondingly subdivided control electrode, onto the anode, which can preferably be realized as a coherent screen electrode, and on which the electrons are imaged as defined picture elements. If a row of the auxiliary anodes is driven, the discharge burns uniformly along the entire electrode, while the negative glow covers a region, the area of which is determined by the well known dependence of the current density at the cathode on the gas pressure. A wedge shaped discharge is particularly advantageous for the overall arrangement.

It is known that the form of the discharge is substantially affected by the nature of the gas and the electrode surface. It has further been found that the square shape of the glow at the anode can be disturbed by still other influences. It has further been found that the desired wedge shaped discharge takes place only when it makes a transition to the anamalous form, i.e., if the discharge current is increased to the extend that the entire cathode is covered.

SUMMARY OF THE INVENTION

It is now an object of the present invention to ensure a wedge shaped discharge in a pictorial display device of the type mentioned at the outset under all operating conditions. According to the present invention, this problem is solved by subdividing the cathode into subcathodes. A group of auxiliary anodes is assigned to each of these subcathodes. Then, only current from a limited number of auxiliary anodes flows to each segment, namely, the auxiliary anodes of the associated group. The number depends, among other things, on the type of gas chosen and its pressure. The number is at least 3 and will not substantially exceed 30.

DETAILED DESCRIPTION OF THE INVENTION

Figure 1:
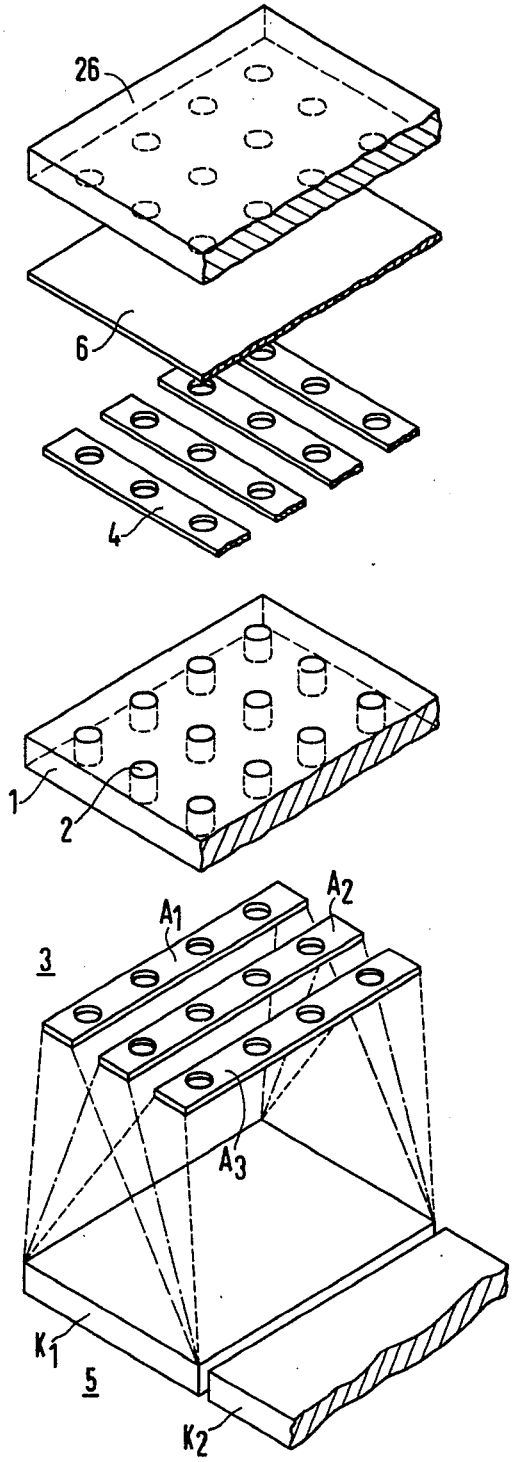
FIG. 1 is an exploded perspective view of a pictorial display device according to the present invention.

In the arrangement according to FIG. 1, a hole plate 1 of electrically insulating material, e.g., quartz, glass, ceramic or also plastic, is provided with a matrix of holes 2, which are arranged in rows and columns. Hole plate 1 is provided with auxiliary anodes 3, which are shaped in the form of strips and arranged parallel to each other as rows designated as $A_1$, $A_2$ and $A_3$ on its lower flat side. On the upper flat side, the hole matrix 1 is provided with control electrodes 4, which are likewise shaped in the form of strips, are crossed as columns relative to the auxiliary anodes 3 and serve for the brightness control of the discharge paths. The individual parts which, in the practical embodiment of the arrangement according to FIG. 1, are normally associated with each other, for instance, lying close together as a sandwich or with a small spacing, are shown in the figure in an exploded view for the sake of greater clarity.

Each auxiliary electrode 3 forms an auxiliary discharge path with the respective associated part of cathode 5. The cathode 5 is therefore arranged at a relatively large distance, which may be, for instance, at least 10 mm, from the auxiliary anodes 3. Compared thereto, the distance of the control electrodes 4 from an anode 6, which serves for acceleration and forms the fluorescent screen electrode, is relatively small; it can be, for instance, about 1 mm. The anode 6 is provided with a cover 26 which consists of optically transparent material, for instance, glass and behind which the picture elements are visible according to the rows and columns of the holes of the hole matrix 1. The control electrodes 4, together with the anode 6, form an acceleration path. A high acceleration voltage of, say, 5 kV is applied between these electrodes.

In comparison, a relatively low switching voltage is applied across the auxiliary discharge path, which may, for instance, be 300 V. Electronic switching elements, which are not shown in the figure are used for controlling the rows and columns. A bias of, for instance, 50 V can be applied to the auxiliary anodes $A_1$ to $A_3$ via individual resistors from a separate voltage source.

If the auxiliary anodes $A_1$ to $A_3$ are controlled by a control arrangement, not shown in the figure, one obtains wedge shaped discharges to the subcathode $K_1$, the boundaries of which are indicated in the figure by dashed lines. According to the present invention, further subcathodes now are provided, of which only the second one $K_2$ is indicated in the figure.

Figure 2:
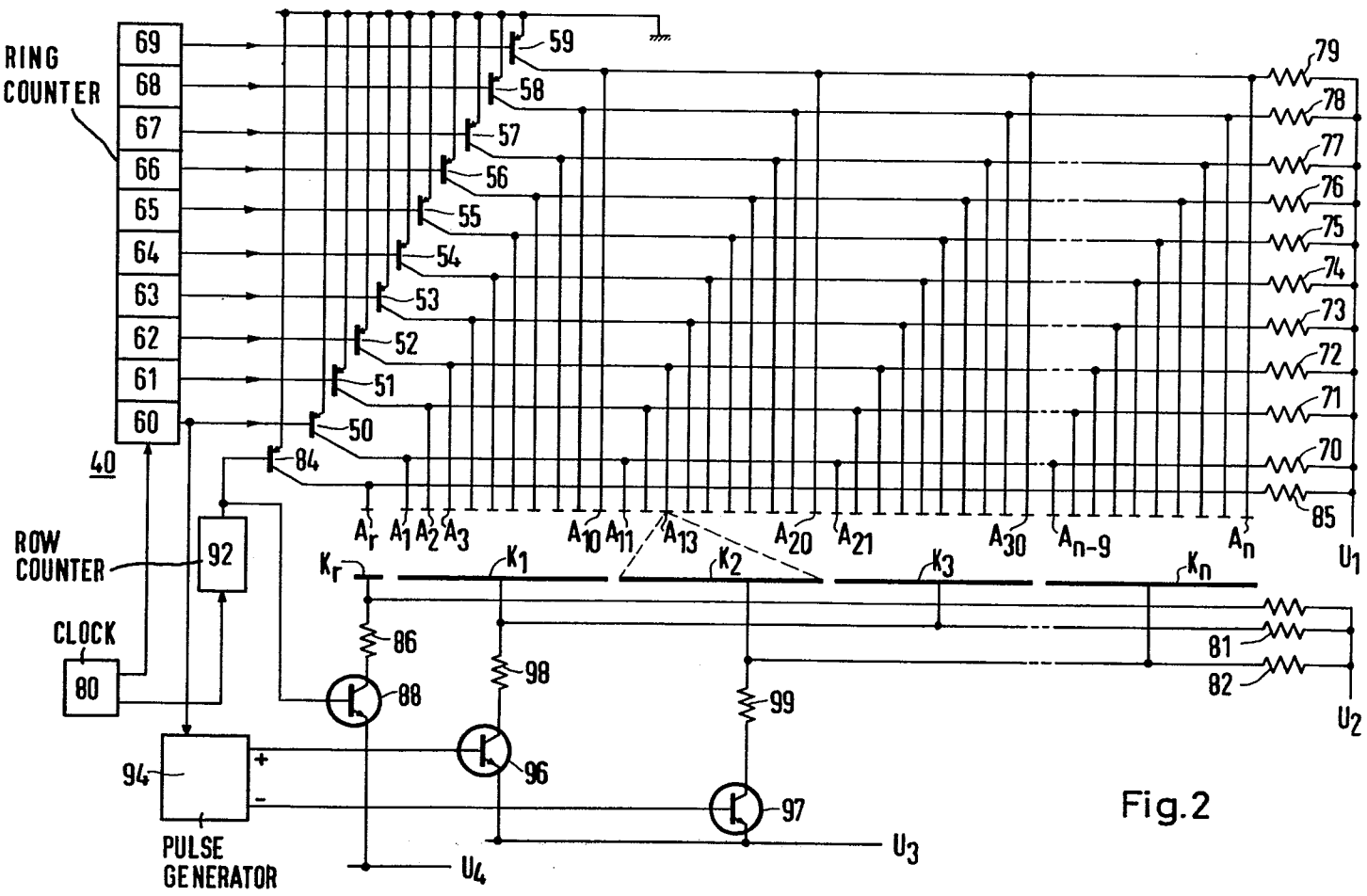
FIG. 2 is a schematic diagram of a scanning system that can be implemented with the electrode configuration according to the present invention.
Figure 3:
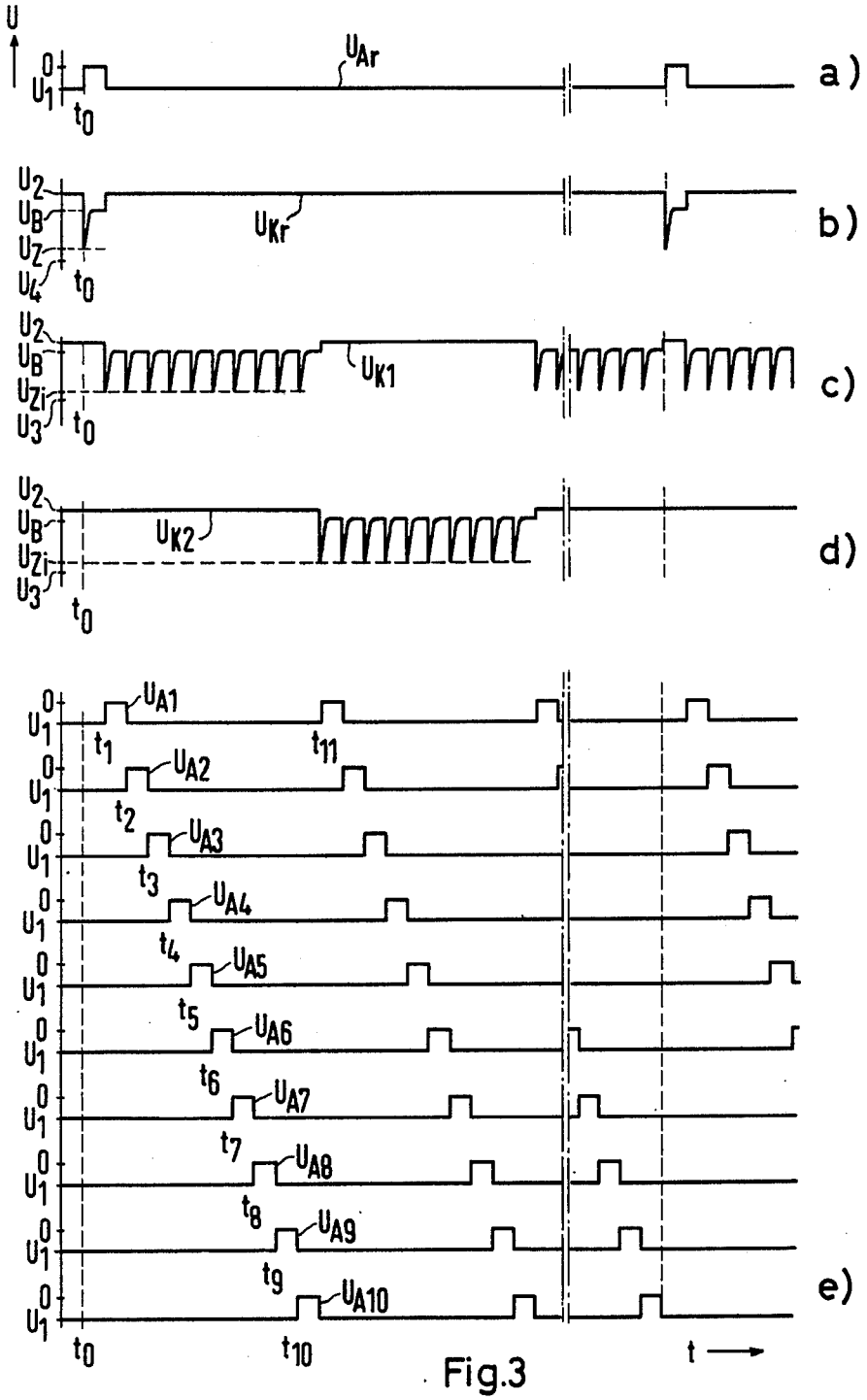
FIG. 3 is a waveform diagram illustrating the operation of the circuit of FIG. 2.

According to FIG. 2, auxiliary anodes $A_1$ to $A_n$ are divided into groups of 10 anodes each, $A_1$ to $A_{10}$, $A_{11}$ to $A_{20}$ and $A_{21}$ to $A_{30}$ as well as $A_{n-9}$ to $A_n$. Of these groups, one auxiliary anode always forms a common phase by parallel connection to one auxiliary anode of all other groups, for instance, the anodes $A_1$, $A_{11}$, $A_{21}$ and $A_{n-9}$. These phases are then each switched by an electronic switching element between zero potential and the voltage $U_1$; the auxiliary anodes $A_1$ to $A_n$ can thus assume zero potential or the voltage $U_1$. The electronic switches in the form of transistors are designated as 50 to 59. A control device 40 acting as a ring counter is associated with these switches. The outputs of control device 40 are designated as 60 to 69 in the figure. The control device 40 receives a pulse sequence from a clock generator 80 which may be an oscillator, for instance. With each input pulse, an output signal is stepped from one of the outputs 60 to 69 to the next following output. The output signal of the last output stage is switched by the following clock pulse back to the first output 60.

A subcathode is assoicated with each individual group of anodes. The subcathodes are designated as $K_1$, $K_2$, $K_3$ and $K_n$. Each group of anodes, for instance, the anodes $A_1$ to $A_{10}$, which are associated with one subcathode, e.g., the subcathode $K_1$, preferably contain at least three auxiliary anodes. In the embodiment according to FIG. 2, each group contains 10 auxiliary anodes. The individual phases of the anodes are each connected through limiting resistors 70 to 79, to an anode voltage $U_1$ with respect to ground. The cathodes are connected to each other alternatingly in paralled i.e., the cathode $K_1$ is connected in parallel to the cathode $K_3$ as well as to all other odd numbered cathodes. This paralleled connection is coupled through a limiting resistor 81 to a cathode voltage $U_2$ with respect to ground. Similarly, the cathode $K_2$ is connected, with further cathodes not shown in the figure, as well as with the cathode $K_n$, and to the cathode voltage $U_2$ via a limiting resistor 82.

For pre-ionizing, the auxiliary anodes $A_1$ to $A_n$ are further associated with a resetting discharge path $A_rK_r$. The resetting anode $A_r$ is tied via an electronic switch 84 to zero potential and is connected via a limiting resistor 85 to the anode voltage $U_1$. Similarly, the resetting cathode $K_r$ is connected via a dropping resistor 86 and an electronic switch 88 to a cathode voltage $U_4$. The switches 84 and 88 receive their control pulses from the clock generator preferably via a row counter 92. The first clock pulse is received only by the control elements 84 and 88, while the remaining clock pulses are simultaneously fed also to the control device 40. The signal at the output 60 of the control device 40 is also fed to a pulse generator 94 with symmetrical output, which may be, for instance, a bistable electronic multivibrator, the outputs of which control the cathode switches 96 and 97. Via the switch 96, the cathode $K_1$ is connected in series with a dropping resistor 98 to a cathode voltage $U_3$. Similarly, the cathode $K_2$ is connected via a dropping resistor 99 and the switch 97 to the switching voltage $U_3$ for the cathodes. The two cathode switches 96 and 97 are switched on and off alternatingly by the output pulses of the pulse generator 94 and the connected subcathodes are thereby connected alternatingly to the cathode voltage $U_3$ and the cathode voltage $U_2$.

The firing voltage $U_{zn}$ of a discharge path is smaller if charge carriers are already present in the discharge path, i.e., if the discharge path is already pre-ionized; it is then reduced to an amount $U_{zi}$. The burning voltage $U_B$ is independent of the pre-ionization. The voltage levels of FIG. 2 are assumed to be negative with respect to ground. The voltage $U_4$ is more negative than the firing voltage $U_{zn}$. The switching voltage $U_3$ for the subcathodes is higher than the firing voltage $U_{zi}$, but lower than the firing voltage $U_{zn}$. The anode voltage $U_1$ must fulfill the conditions: $U_3 - U_1 < U_B$. The cathode voltage $U_2$ is likewise lower than $U_B$.

In the practical embodiment of the switches according to FIG. 2, 10 groups of anodes are assumed to be formed, for instance, of which only the first three anode groups and the last one are shown in the figure. One of the subcathodes $K_1$, $K_2$, $K_3$ to $K_n$ is assigned to each of these anode groups. Since adjacent subcathodes must not be at the same voltage, the odd-numbered cathodes $K_1$, $K_3$ and the other odd-numbered subcathodes not shown in the figure are alwasy connected in parallel. Similarly, the even subcathodes, of which only the subcathode $K_2$ and the last cathode $K_n$ are indicated in the figure, are connected parallel. For switching back after stepping through to the anode $A_n$, pre-ionization for the first anode $A_1$ of the first group of auxiliary anodes ($A_1$ to $A_{10}$) is needed again. For this purpose, the resetting anode $A_r$ and the resetting cathode $K_r$ are provided, which either have a somewhat higher firing voltage or oppose each other with a somewhat smaller spacing. With this discharge path $A_rK_r$, pre-ionization of the auxiliary discharge paths is obtained when the whole arrangement is switched on as well as after one run though of the discharge.

In FIGS. 3*a* to 3*d*, the respective waveforms of different voltages and pulses of the circuit according to FIG. 2 are plotted in a diagram versus the time t. All transistors are initially assumed to be cut off. At the time $t_o$, the clock generator 80 drives the switches 84 and 88 into conduction, according to FIG. 3*a*, while the output to the control device 40 is blocked by electronic circuitry not shown in the figure. The voltage $U_{Ar}$ at the resetting anode $A_r$ goes from the voltage $U_1$ to zero potential and the voltage $U_{Kr}$ at the associated resetting cathode $K_r$ attempts, according to FIG. 3*b*, to assume the switching voltage $U_4$. The discharge path already is fired with a voltage difference of $U_{zn} < U_4$ between the resetting anode $A_r$ and the resetting cathode $K_r$ and burns thereafter with the burning voltage $U_B$ until the transistors 84 and 88 are cut off again. At the time $t_1$, the second clock pulse of the clock generator 80 appears, according to FIG. 3*e*, on both output lines via the control device 40 to the switch 50 as well as via the control device 94 to the switch 96. The voltage $U_{A1}$ at the anode $A_1$ becomes zero. The voltage $U_{K1}$ at the cathodes $K_1$ and $K_3$ approaches the switching voltage $U_3$, according to FIG. 3*c*. However, because of the pre-ionization, the path $A_1K_1$ is already fired at the voltage $U_{zi}$. The voltage between the anode $A_{21}$ and the cathode $K_3$ is thereby limited to the burning voltage $U_B$, so that these paths do not fire. The potential $U_{K2}$ at the cathode $K_2$ remains at the cathode voltage $U_2$, according to FIG. 3*d*. Therefore, the voltage difference between the anode $A_{21}$ and the subcathode 2 is too small for firing the path. The discharge therefore burns only between the anode $A_1$ and the cathode $K_1$. The current is adjusted so that the discharge covers the subcathode $K_1$ completely, i.e., this discharge burns in the normal mode.

At the third clock pulse at the time $t_2$ the switch 96 remains open, while the switch 50 is blocked and the switch 51 receives a control pulse via the output 61, so that now the discharge burns between the anode $A_2$ and the cathode $K_1$, and the anode voltage $U_{A2}$ at the anode $A_2$ becomes zero. At the fourth clock pulse at the time $t_3$ and the following clock pulses, the discharge always jumps to the respective, next following anode. Accordingly, the anode voltages $U_{A3}$ to $U_{A10}$ become successively zero. After the eleventh clock pulse, the discharge therefore burns at the time $t_{10}$ between the last anode $A_{10}$ of the first group and the subcathode $K_1$. At the twelfth pulse at the time $t_{11}$, the switch 59 is blocked and the switch 50 fired again. At the same time, however, the switch 96 is blocked and the switch 97 conducts. The second group is therefore already pre-ionized and the first anode $A_{11}$ fires through, according to FIG. 3*d*, to the second subcathode $K_2$. The following clock pulses fire successively the respective following anodes of the second gorup and the discharge burns between these respective anodes and the subcathode $K_2$. Similarly, the anodes of the following groups of anodes are fired successively. When the discharge has reached the last anode $A_n$ of the last group, it is only necessary to fire the resetting anode $A_r$ and the associated resetting cathode $K_r$ to initiate the discharge cycle over again.

As is well known, conventional television pictures are assembled by letting the cathode ray sweep first individual lines and subsequently, the interleaved lines. In the case of a picture screen with, say 625 lines, the anodes corresponding to the picture rows are then addressed in the sequence 1, 3, 5 . . . to 625 and then the missing rows 2, 4, 6 . . . to 624. The scanning system of a reproduction device according to the present invention is suitable also for such a picture reporduction, as it has been found that the described pre-ionization is still effective if several anodes are skipped.

What is claimed is:

1. In a pictorial display device with a matrix of gas discharge cells which include an anode and a cathode and having associated auxiliary anodes for controlling the rows and control electrodes for the brightness control of the columns with an auxiliary gas discharge path between the cathode and the auxiliary anodes and an electron acceleration path between the control electrodes and the anode, the improvement comprising the cathode being made up of a plurality of subcathodes and each of said subcathodes being associated with a group of auxiliary anodes.

2. The improvement according to claim 1, wherein each subcathode is associated with a group of at least three auxiliary anodes.

3. The improvement according to claim 2, wherein one auxiliary anode of each group is coupled in parallel with a corresponding auxiliary anode in all other groups and to a common control means thereby forming a common phase.

4. The improvement according to claim 3 and further including a resetting discharge path associated with the auxiliary discharge paths for pre-ionization.

5. The improvement according to claim 1, wherein one auxiliary anode of each group is coupled in parallel with a corresponding auxiliary anode in all other groups and to a common control means thereby forming a common phase.

6. The improvement according to claim 5 and further including a resetting discharge path associated with the auxiliary discharge paths for pre-ionization.

7. The improvement according to claim 1 and further including a resetting discharge path associated with the auxiliary discharge paths for pre-ionization.

* * * * *